United States Patent [19]

DeHerrera

[11] 4,206,773

[45] Jun. 10, 1980

[54] HAIR HOLDER

[76] Inventor: William A. DeHerrera, 1301 N. Allen, Farmington, N. Mex. 87401

[21] Appl. No.: 840,327

[22] Filed: Oct. 7, 1977

[51] Int. Cl.[2] ..... A45D 24/36

[52] U.S. Cl. ..... 132/45 R

[58] Field of Search ..... 132/45 R, 130, 133, 132/141, 161; 2/174, 410; D28/10

[56] References Cited

U.S. PATENT DOCUMENTS

| | | | |
|---|---|---|---|
| 1,537,783 | 5/1925 | Olson | 132/45 R |
| 1,812,081 | 6/1931 | Chaumier | 132/130 |
| 2,529,149 | 11/1950 | Fred | 132/45 R |
| 2,722,223 | 11/1955 | Fox, Sr. | 132/45 R |
| 2,778,366 | 1/1957 | Richmond | 132/45 R |
| 2,879,777 | 3/1959 | Miller | 132/45 R |
| 3,202,158 | 8/1965 | Dumont | 132/45 R |

*Primary Examiner*—G. E. McNeill

*Attorney, Agent, or Firm*—Clarence A. O'Brien; Harvey B. Jacobson

[57] ABSTRACT

A hair holding device for facilitating cutting of hair has a frame arrangeable on a head of a person whose hair is to be cut, and a gauge mounted on the frame for determining the length of hair to be cut. The gauge includes a plurality of wedge-shaped members through which clumps of hair are passed and cut down to the outer surface of the wedge, with each of the wedges being of substantially the same height from the scalp of the person whose hair is being cut in order to give a uniform cut about the head of the person.

7 Claims, 8 Drawing Figures

10
12
14
16
18
20
22
24
26
28
30
32
34
34'
36
38
40
26,28
H
S
3

Fig. 3
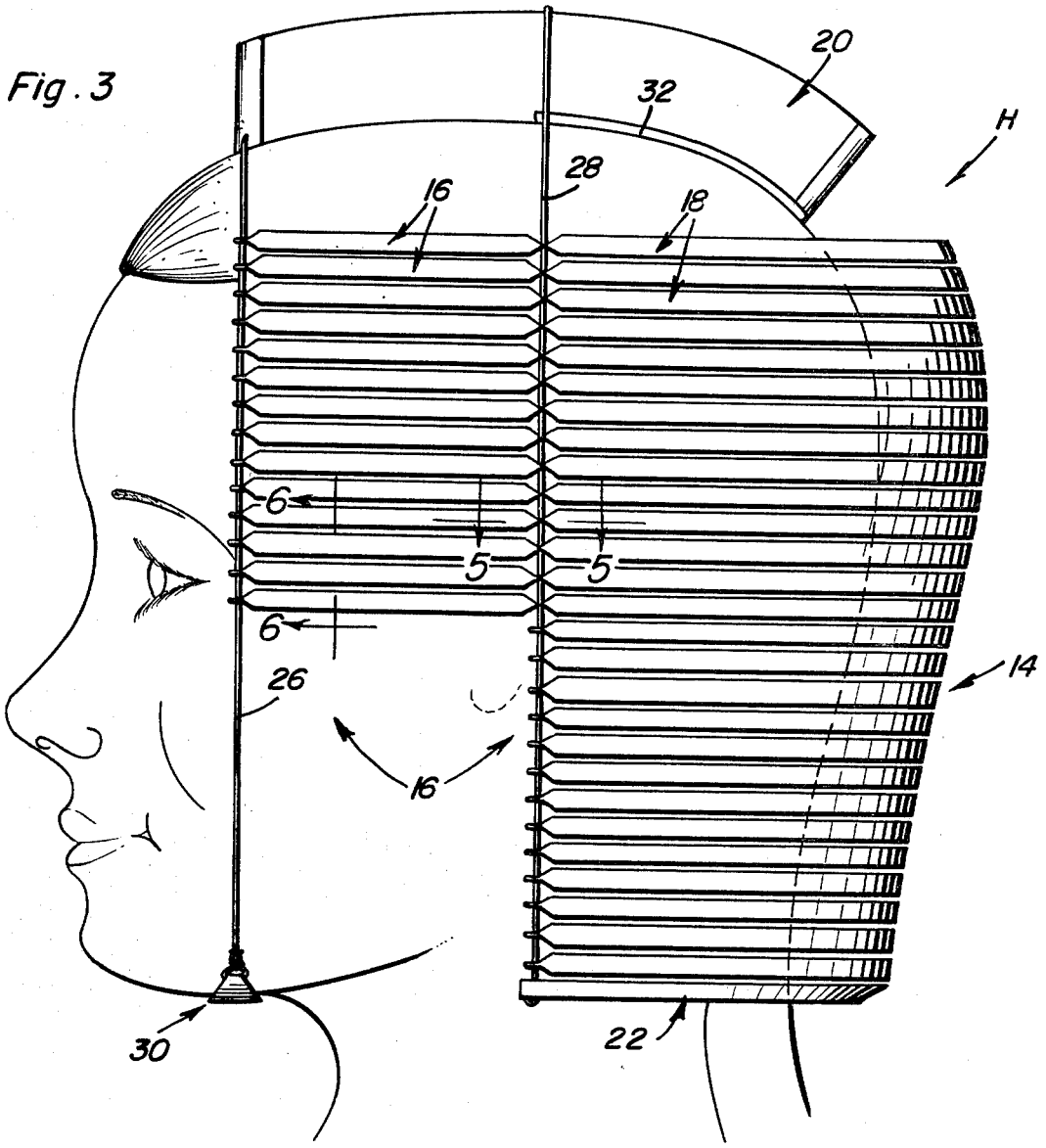
Fig. 4
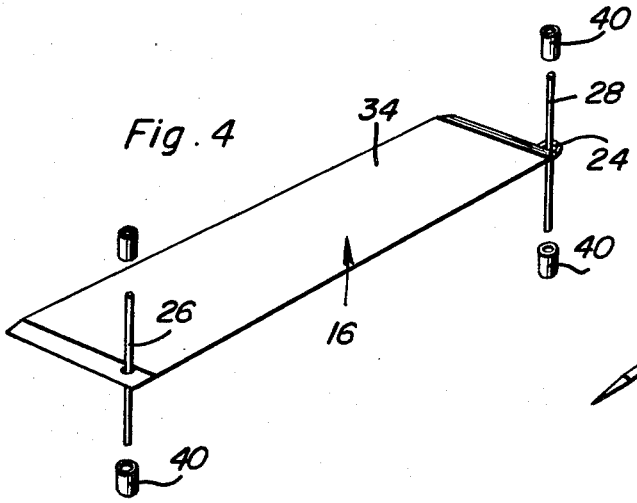
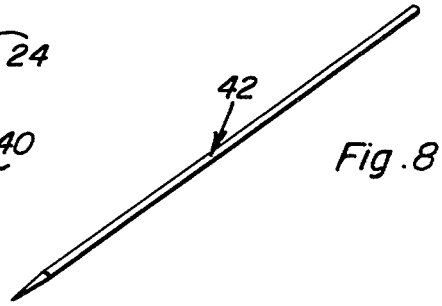
Fig. 8

HAIR HOLDER

BACKGROUND OF THE INVENTION

1. Field of the Invention

This invention relates generally to hair styling aids, and particularly to a device for cutting hair at a uniform length about the head of a person whose hair is being cut in order that the hair, once cut and dried, will fall and layer evenly.

2. Description of the Prior Art

It is generally known to provide a cap, and the like, which fits over one's head and is provided with apertures to facilitate the cutting of hair. For example, U.S. Pat. No. 3,972,075, issued Aug. 3, 1976, to C. J. Alevras, discloses a hair stylist's haircutting helmet which includes a plurality of apertures through which hair is drawn as by a suction device so that the hair can be cut off at a predetermined point. While the aforementioned U.S. Pat. No. 3,972,075 is primarily intended for use in obtaining a uniform cut and shape to hair, in accordance with contemporary styling, the use of haircutting guides has long been known that are constructed from a framework which fits on the head and includes a plurality of spaced elements through which the hair is arranged in order to facilitate the cutting process. Examples of the latter haircutting guides can be found in U.S. Pat. No.: 2,347,587, issued Apr. 25, 1944, to Z. L. Wiles; U.S. Pat. No. 2,542,450, issued Feb. 20, 1951, to J. A. Altman; and U.S. Pat. No. 2,698,018, issued Dec. 28, 1954, to W. Post.

U.S. Pat. No. 2,575,589, issued Nov. 10, 1951, to A. C. Glick, discloses a method of curling hair which employs a a slotted helmet similar to that disclosed in the aforementioned U.S. Pat. No. 3,972,075, and which could conceivably be employed as a haircutting guide.

SUMMARY OF THE INVENTION

It is an object of the present invention to provide a hair holding device capable of being used when cutting various hair styles and cutting lengths.

It is another object of the present invention to provide a hair holding device especially suited for use in cutting the contemporary evenly layered hair styles.

It is yet another object of the present invention to provide a haircutting device which requires only two basic cuts to be made in order to evenly cut an entire head of hair.

These and other objects are achieved according to the present invention by providing a hair holding device having: a frame arrangeable on a head of a person whose hair is to be cut; and a gauge mounted on the frame for determining the length of the hair to be cut and facilitating the cutting process itself. The frame includes an open framework contoured to conform substantially to the shape of a human head, with the gauge including a plurality of wedge-shaped members mounted in adjacent relation on the framework. Each of these wedge-shaped members extends longitudinally, and are arranged side-by-side on the framework with a space provided between adjacent ones of the members for receiving a quantity of hair to be cut.

According to a preferred construction of the invention, the framework includes a plurality of elongated elements formed into substantially U-shaped elements arrangeable over the head of a person whose hair is to be cut, with the wedge-shaped members being disposed extending between and attached to an associated pair of the elements.

Each of the wedge-shaped members has a cross section in the shape of an isosceles triangle having equal sides including an angle. A base is arranged between the sides and opposite the angle of the triangular cross section, with the distance between the angle and base of each of the members being substantially the same as the distance between the angle and base of the cross section of the other members in order to achieve a uniform cut. Each of the wedge-shaped members is oriented with the angle included between the equal sides of the triangular cross section attached to the elongated elements for support thereby.

A portion of the wedge-shaped members is longer than the other of the members, with most of the members being curved to conform to an associated portion of a head of a person wearing the device.

These together with other objects and advantages which will become subsequently apparent reside in the details of construction and operation as more fully hereinafter described and claimed, reference being had to the accompanying drawings forming a pair hereof, wherein like numerals refer to like parts throughout.

BRIEF DESCRIPTION OF THE DRAWINGS

FIG. 3 is a schematic, side elevational view, as seen in the direction of the line 3—3 in FIG. 1.

FIG. 4 is an exploded, perspective view showing one of the wedge-shaped members forming a hair holding device according to the present invention.

FIG. 8 is a perspective view showing a needle used in conjunction with a hair holding device according to the present invention to pull hair between the wedge-shaped members of the device.

DESCRIPTION OF THE PREFERRED EMBODIMENTS

Figures 1, 2, 5, 6, 7:
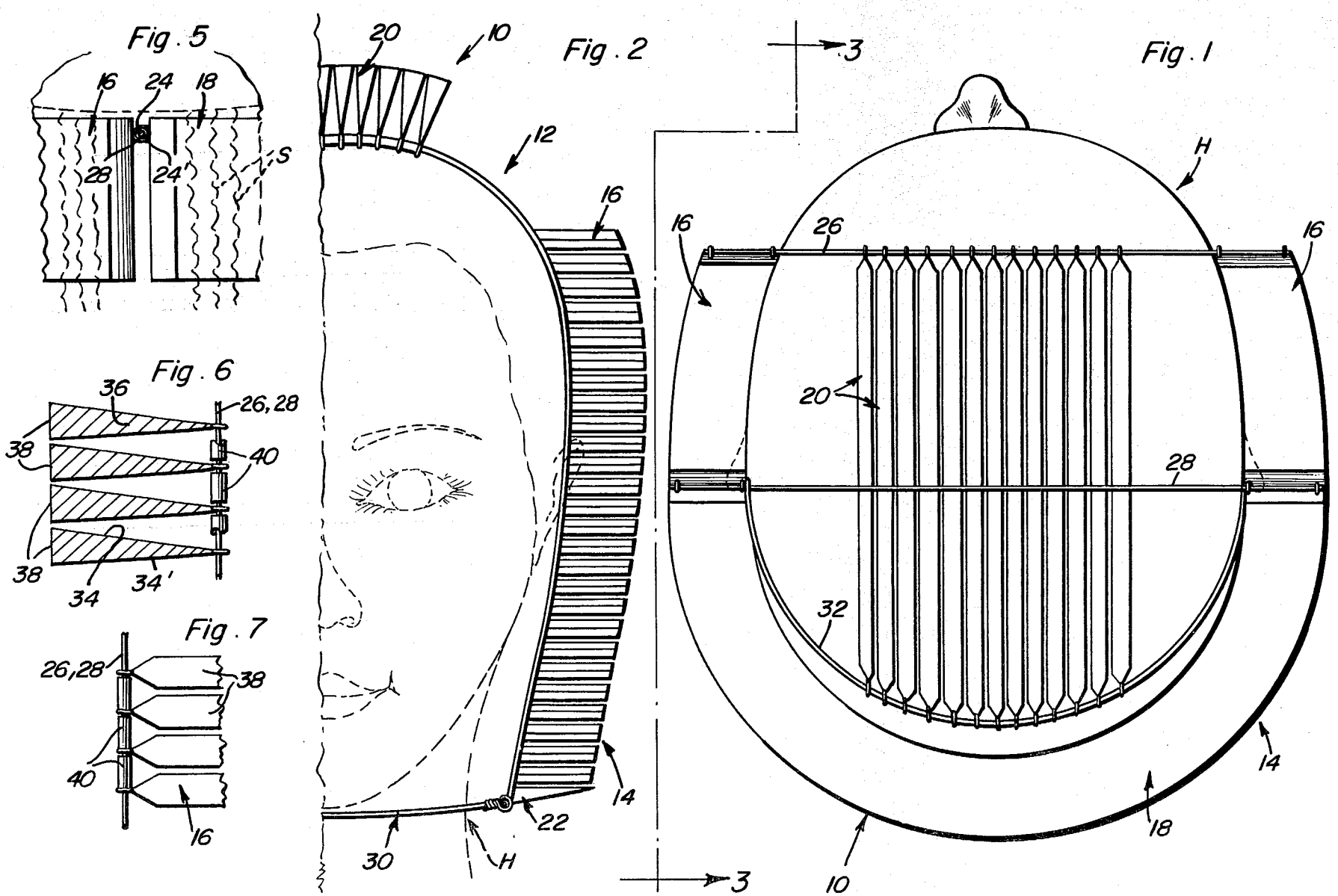
FIG. 1 is a schematic, top plan view showing a hair holding device according to the present invention arranged on the head of a person whose hair is to be cut.
FIG. 2 is a fragmentary, front elevational view, showing one half of the arrangement as seen in FIG. 1.
FIG. 5 is an enlarged, fragmentary, schematic view looking in the direction of the line 5—5 in FIG. 3.
FIG. 6 is an enlarged, fragmentary, schematic, cross-sectional view taken generally along the line 6—6 of FIG. 3.
FIG. 7 is an enlarged, fragmentary, schematic view showing in detail the lower left hand portion of the left hand wedge-shaped members as seen in FIG. 3.

Referring now more particularly to FIGS. 1 through 7 of the drawings, a hair holding device 10 according to the present invention comprises a frame 12 arrangeable on a head H of a person whose hair S is to be cut, and a gauge assembly 14 mounted on frame 12 for determining the length to which the hair is to be cut. Frame 12 includes an open framework contoured to conform substantially to the shape of human head H. The fit of the framework to head H is not critical, since even if the frame 12 fits head H a little big, it is the outside surface of gauge assembly 14 that is determining as to the length to which the hair is to be cut. Gauge assembly 14 includes a plurality of wedge-shaped members, straight members 16, C-shaped members 18 and arcuate members 20 mounted in adjacent relation to at least one member of the same kind on the framework forming frame 12. In addition, a single lower C-shaped member 22 is provided. As can be readily seen from the drawings, members 18 and 20 are substantially longer than members 16, with the former being curved to conform to an associated portion of head H. More specifically, member 18 is almost semi-circular in configuration to fit entirely around the back of head H from adjacent the ears thereof, while members 20 are curved slightly to conform to the curvature of the top of head H. Members 16 are arrangeable adjacent the sides of head H, and therefore need not be curved to any great extent, if at all.

As can best be seen from FIGS. 4 and 5, each of the members 16 has at one end thereof an eye 24 which cooperates with eye 24' terminating the ends of members 18 in order to tie together members 16 and 18 in a manner to be described below.

The framework forming frame 12 includes a plurality of elongated elements, such as lengths of self-supporting wire, among which elements are those designated 26 and 28 formed into substantially U-shape and arrangeable over head H. A strap 30 proceeds under the chin of the person whose hair is to be cut in order to retain the frame 12 on head H. The framework also includes an element 32 which extends around the upper back portion of head H and is connected to element 28 near the top of head H for holding the rearwardly disposed ends of members 20 in proper position. The front ends of members 20 are connected to element 26. Suitable apertures are provided in the associated ends of the various members for receiving the elements 26, 28 and 32, with eyes 24, 24' serving the purpose of receiving element 28 in such a manner as to attach members 16 and 18 to one another in such a manner as to effectively form one continuous gauge member.

The wedge-shaped members 16, 18, and 20 each has a transverse cross section the shape of an isosceles triangle having equal sides 34, 34' including an angle 36. A base 38 is arranged between sides 34, 34' opposite angle 36, with the distance between angle 36 and base 38 of each of the members being substantially the same as the distance between the angle 36 and base 38 of the transverse cross section of the other of the members. Each of the wedge-shaped members 16, 18, and 20 is oriented with the angle 36 being adjacent to the point of attachment of an element 26, 28, 32 to the associated members 16, 18, and 20.

Spacers 40 are arranged on elements 26, 28 so as to be in between the associated wedge-shaped members and space from one another the portions of the members 16, 18 and 20 adjacent the edge formed by angle 36. With the members 16, 18, and 20 thus strung along on elements 26, 28, and 32, it will be appreciated that the outer portions of the members, formed by the base 38, can be pushed apart far enough in order to permit locks or tufts of hair to be pulled outwardly from head H to the outside of device 10. To facilitate in a proper spacing, the longitudinal ends of the members 16, 18, and 20 are advantageously pointed, or sides 34, 34' arranged converging toward one another.

Member 22 is only one in number and presents a substantially planar upwardly disposed surface for forming a support for the lowermost of the wedge-shaped members 18 in order to retain the wedges 18 in a substantially front-to-rear orientation with respect to head H. That is, the large, curved members 18, which extend entirely around the back portion of head H, are prevented from sagging downwardly by attachment of a finite thickness of curved member 22 to the ends of U-shaped element 28.

FIG. 8 illustrates a needle 42 which can be used in conjunction with device 10 for picking hair from between members 16, 18, 20, and 22 so that the hair may be combed out and cut at the edge of the members 16, 18, 20, and 22. Before cutting, the hair should be wetted. After the hair is cut, the device is removed and the hair is dried, in a conventional manner, the hair will fall and layer evenly. Very little trimming, possibly only around the edges of hair on head H, is required after device 10 is removed. The length of the cut hair will be determined by the length of the members 16, 18, and 20 between base 38 and angle 36, with it being possible to vary the length simply by changing sizes of members 16, 18, and 20.

As can be readily understood from the above description and from the drawings, a hair holding device 10 according to the present invention permits hair to be uniformly cut in a simple and easy manner, with it being only necessary to make two basic cuts: one along the sides as defined by wedge-shaped members 16 and 18, and the other along the top as defined by wedge-shaped members 20.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hair holding device for facilitating cutting of hair, said device comprising a downwardly opening frame contoured to conform substantially to the shape of a human head and arrangeable on a head of a person whose hair is to be cut, said frame including a pair of upstanding opposite side support and guide members, gauge means, said gauge means including a plurality of closely opposing generally horizontal vertically registered and forwardly opening C-shaped gauge members, said members being wedge shaped in cross section and tapering in thickness inwardly toward the central portion of the area bound thereby, said members including inner portions thereof slidingly supported on said support and guide members for limited vertical shifting therealong and adapted to loosely embracingly receive the rear and opposite side portions of a human head therein, said gauge members being positionable on said guide members in slightly vertically spaced apart relation, whereby the free end portions of the hairs in vertically spaced horizontal zones of hair on the associated human head may project outwardly from and be gripped between adjacent gauge members and be cut along the outer surfaces of the gauge members.

2. The combination of claim 1 wherein said frame includes front and rear pairs of opposite side support and guide members, said C-shaped gauge members extending between and being slidingly supported from the rear support and guide members, and a plurality of generally straight additional gauge members guidingly supported from and extending between the front and rear support and guide members on each side of said frame for limited shifting along said front and rear support and guide members.

3. The combination of claim 2 including an elongated flexible chin strap extending and secured between the lower end portions of said front support and guide members.

4. The combination of claim 2 wherein said additional gauge members are also wedge shaped in cross section.

5. The combination of claim 2 wherein said frame includes a rear forwardly opening upper U-shaped element supported from and opening forwardly toward the upper end portions of the rear support and guide members, said front support and guide members being interconnected by means of an integral downwardly opening arch element extending therebetween, a plurality of upper gauge members extending in front to rear directions and supported at their forward ends from said arch element and at their rear ends from said U-shaped element, said upper gauge members being substantially parallel and being spaced apart transversely of said frame.

6. The combination of claim 5 wherein said gauge members are wedge shaped in cross section and tapered in thickness inwardly toward the central portions of the area bound by said C-shaped gauge members.

7. The combination of claim 6 wherein the rear end portions of said upper gauge members curve downwardly.

* * * * *